US005488791A

United States Patent [19]

Boni

[11] Patent Number: 5,488,791

[45] Date of Patent: Feb. 6, 1996

[54] DEVICE FOR DISPLAYING A SERIES OF ADVERTISEMENTS IN A DISPLAY WINDOW

[75] Inventor: Alfredo Boni, Banchette, Italy

[73] Assignee: DIMA S.r.l., Ivrea, Italy

[21] Appl. No.: 162,348

[22] Filed: Dec. 2, 1993

[51] Int. Cl.[6] ..... G09F 11/18

[52] U.S. Cl. ..... 40/467; 40/471; 40/518

[58] Field of Search ..... 40/466, 467, 471, 40/518, 520, 522, 574

[56] References Cited

U.S. PATENT DOCUMENTS

| | | | |
|---|---|---|---|
| 3,510,973 | 5/1970 | Mazzocco, Sr. | 40/471 |
| 3,780,458 | 12/1973 | Jacoby et al. | 40/518 |
| 4,110,925 | 9/1978 | Strand et al. | 40/471 X |
| 5,003,717 | 4/1991 | Trame et al. | 40/471 X |
| 5,353,534 | 10/1994 | Fassauer et al. | 40/537 X |
| 5,355,601 | 10/1994 | Paulsen | 40/471 |

*Primary Examiner*—Brian K. Green
*Attorney, Agent, or Firm*—Baker & Daniels

[57] ABSTRACT

A device comprising a box having a transparent wall illuminated from the inside. The advertisements are joined to form a single flexible strip support which is wound and unwound between two parallel rollers. One of the rollers is fitted removably to the frame of the device, for enabling the support to be changed, and is rotated intermittently by an electric geared motor. The other roller is rotated by a torsion spring which provides for constantly tensioning the support.

16 Claims, 9 Drawing Sheets

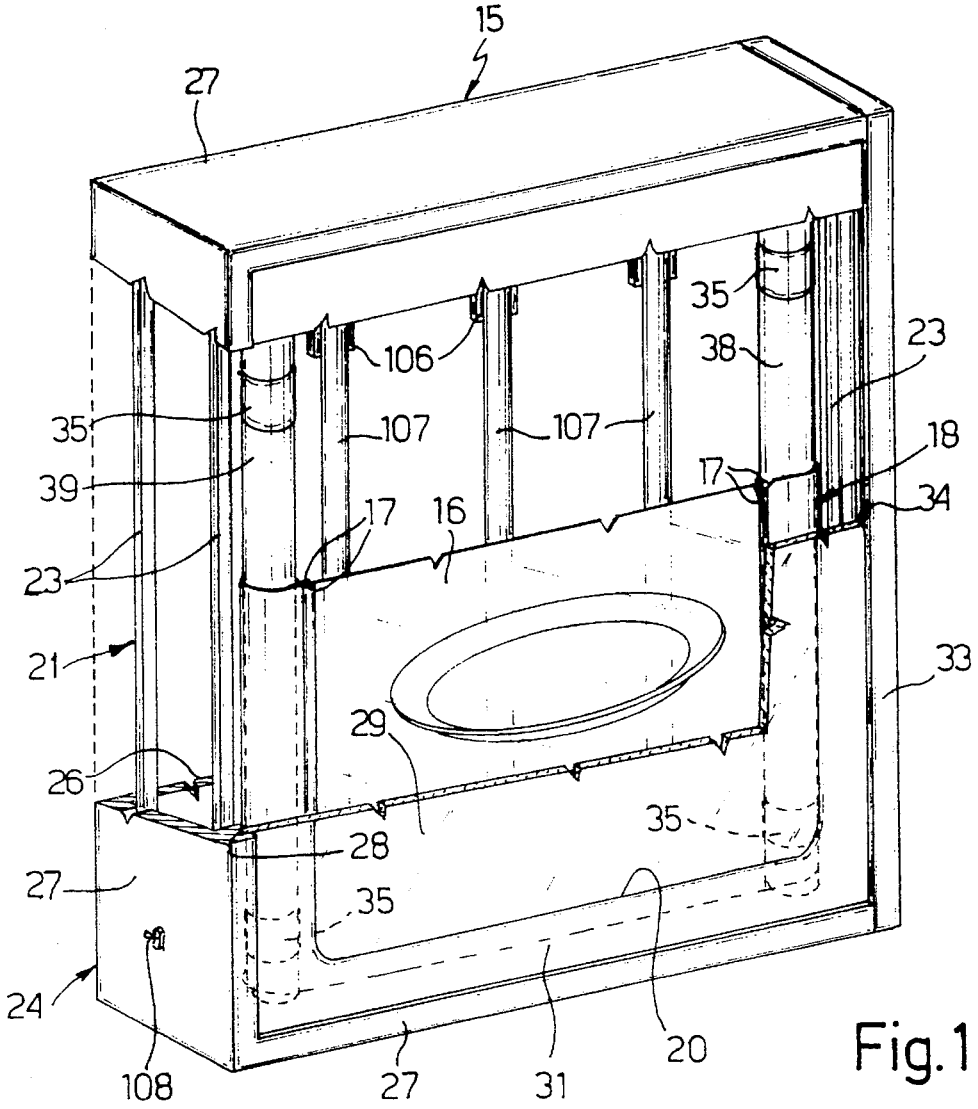
Fig.1
Fig.2
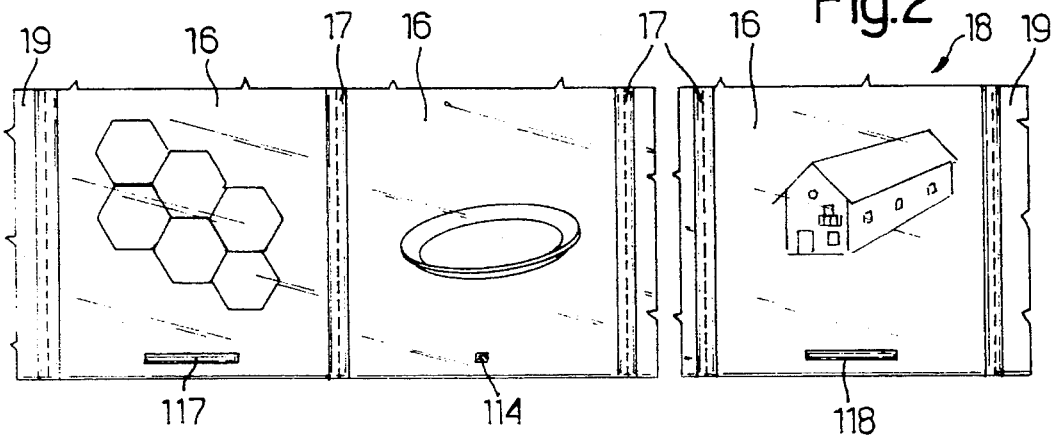

DEVICE FOR DISPLAYING A SERIES OF ADVERTISEMENTS IN A DISPLAY WINDOW

BACKGROUND OF THE INVENTION

The present invention relates to a device for displaying a series of advertisements in a display window.

Various display devices of the aforementioned type are already known. One of these presents a prismatic support normally fitted with an advertisement on each face, and which is rotated in steps so as to display one face at a time at the display window. A major drawback of this type of device is that it requires the use of large-size prisms, and provides for displaying only a limited number of advertisements, any increase in which involves frequent replacement of the prism.

To reduce the size of the system, the advertisements of another known device, widely used in sports stadiums, are divided into a number of rectangular portions, each fitted to a respective prism. Such a device presents several drawbacks, in that it requires a highly complex mechanism for simultaneously rotating all the prisms; provides for poor quality display, by virtue of the image being split noticeably by horizontal and vertical lines; and, as in the previous case, provides for displaying only a limited number of advertisements, replacement of which, however, in this case is even more complex.

A further device is also known in which the advertisements are carried on a flexible strip which is wound and unwound between two parallel rollers on either side of the display window. The two rollers are rotated by a single motor and two chains engaging two pulleys, each connected to the respective roller by a respective idle wheel, so that the device is invariably noisy due to idling of the wheels.

SUMMARY OF THE INVENTION

It is an object of the present invention to provide a device for displaying a series of advertisements, which is extremely straightforward in design, highly reliable, and provides for eliminating the aforementioned drawbacks typically associated with known devices.

According to the present invention, there is provided a device for displaying a series of advertisements in a display window; characterized by the fact that said advertisements are carried on a flexible strip support wound and unwound between two parallel rollers; said support being fitted, on one side, to a first of said rollers and, on the other side, to a second of said rollers; and said device comprising a reversible electric motor for intermittently rotating at least said first roller, for successively displaying said advertisements one at a time; and elastic means acting on said second roller, for permanently maintaining said support at a predetermined tension.

BRIEF DESCRIPTION OF THE DRAWINGS

A number of preferred, non-limiting embodiments of the present invention will be described by way of example with reference to the accompanying drawings, in which:

FIG. 1 shows a partially sectioned view in perspective of an advertisement display device according to a first embodiment of the present invention;

FIG. 2 shows a larger-scale part view of the advertisement support;

DETAILED DESCRIPTION OF THE INVENTION

Figure 3:
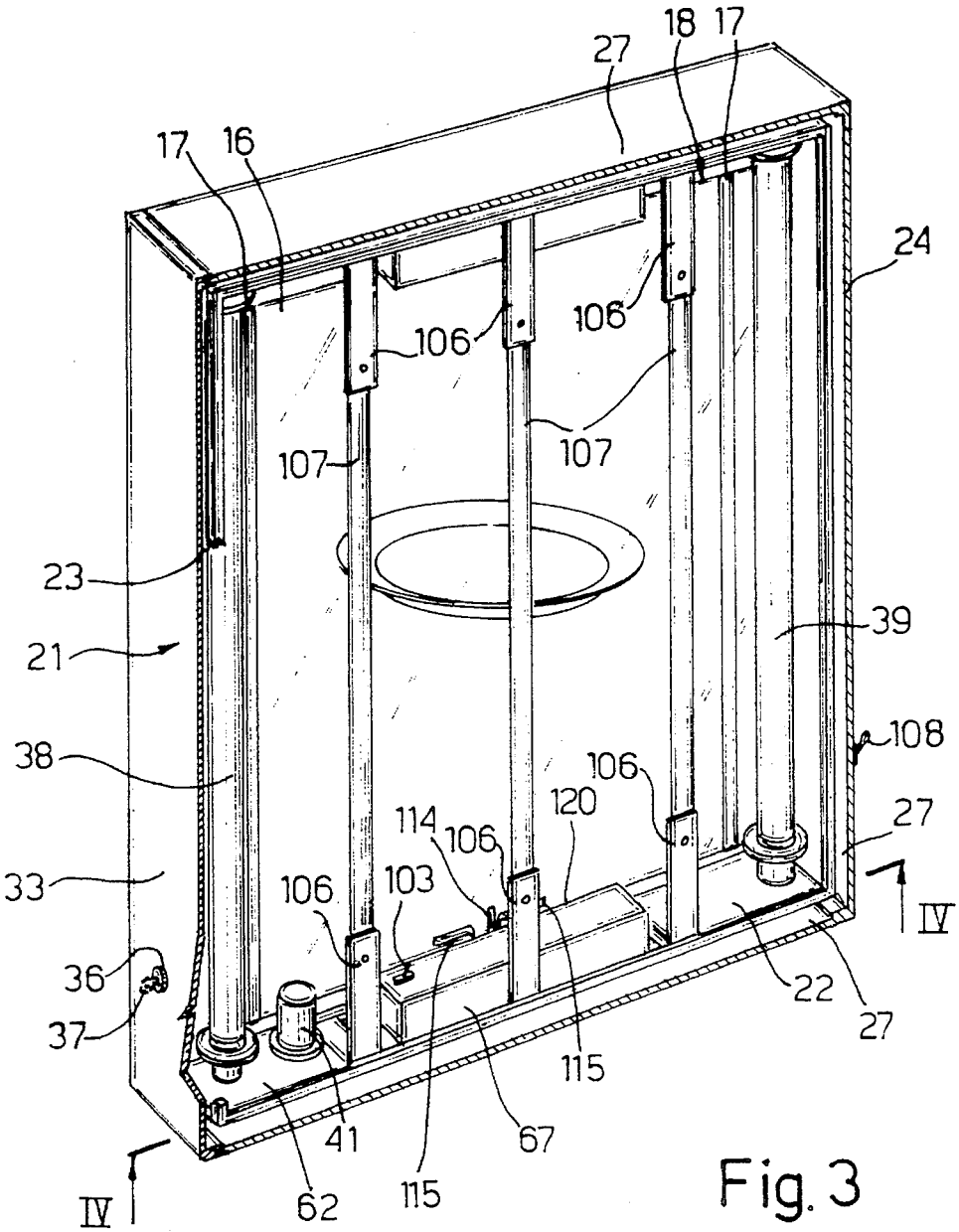
FIG. 3 shows a rear vertical section of the device.

Number 15 in FIG. 1 indicates a device for displaying, e.g. publicly, advertisements 16. Each advertisement 16 is preferably formed on a flexible sheet consisting of a transparent photographic film, such as a slide, possibly ranging in thickness from 0.1 to 1 mm. Alternatively, one or more advertisements 16 may be formed on a sheet of substantially transparent paper.

The films or sheets of advertisements 16 are joined on both faces and along the side edges by means of two portions of adhesive tape 17 (FIG. 2) to form a single flexible strip support indicated as a whole by 18. For enabling display of the two end advertisements 16, these are provided with an end portion 19 of appropriate length.

Tape 17 may range in width between 2 and 3 cm; must be such as to adhere to developed film; must be resistant to bending and crosswise pull; and may preferably consist of one inch wide 8422 2PKC adhesive tape marketed by 3M.

Device 15 in FIG. 1 provides for displaying one advertisement 16 at a time in a front display window 20, and for feeding support 18 perpendicularly to tapes 17, i.e. horizontally; and comprises an inner frame 21 consisting of two metal section horizontal members 22 (FIG. 3) connected by a series of vertical members 23.

Figure 4:
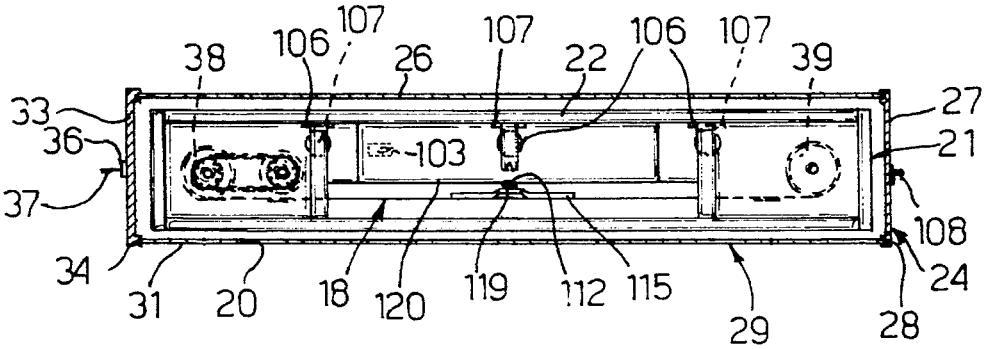
FIG. 4 shows a section along line IV—IV in FIG. 3.

Frame 21 is enclosed inside a box 24 comprising a rear wall 26 (FIG. 4) in the form of an opaque panel; and three walls 27—respectively a top, bottom and lateral wall—to which wall 26 is fitted. Frame 21 is fitted in removable manner to bottom wall 27 and possibly also to the other two walls 27.

Each wall 27 presents a groove 28 in which is housed a respective side of a front wall 29 forming transparent display window 20 which may be surrounded by an opaque portion 31. Box 24 also comprises a removable vertical wall 33 having a groove 34 engaged by the other vertical side of front wall 29.

Wall 33 also engages rear wall 26; presents two appendixes (not shown) designed to engage a recess on the free edge of the two horizontal walls 27; and is lockable on to an element of frame 21 by means of a lock 36 with a key 37 for locking box 24.

After unlocking and removing wall 33, front wall 29 may be bent slightly for removing it easily from grooves 28 and box 24, and so enabling access inside box 24 for changing support 18 of advertisements 16 or carrying out any other work on device 15.

Strip support 18 of advertisements 16 is moved intermittently by means of two rollers 38 and 39 mounted for rotation on frame 21, on either side of wall 29, and each wound with a portion of support 18.

For tensioning support 18 over its entire width and ensuring it is wound correctly on to rollers 38 and 39, each roller 38, 39 is fitted close to each end with a band 35 (FIG. 1) consisting, for example, of a strip of paper wound about the end of the roller, and forming a shim, preferably ranging in thickness from 0.2 to 2 mm, for ensuring firm grip of the lateral portions of support 18 without having to excessively grip the central portion of support 18 on rollers 38 and 39.

Rollers 38 and 39 are rotated simultaneously for feeding advertisements 16 back and forth past display window 20. Roller 38 (FIG. 5) is fitted removably to frame 21 to enable replacement of support 18, and, being driven by a reversible electric geared motor 41, is hereinafter referred to as the drive roller; whereas roller 39 (FIG. 6) is activated by elastic means consisting of a torsion spring 42, and is hereinafter referred to as the driven roller.

DRIVE ROLLER

Drive roller 38 (FIG. 5) consists of a sheet metal tube 40 fitted at the top end to a disk 43 having a bush 44 which is engaged with a certain amount of radial slack by a pin 45 fitted to a cylinder 46 sliding axially inside the seat 47 of a sleeve 48 at which disk 43 presents an annular recess 50. Sleeve 48 presents a flange 51 fitted to a plate 52 in turn fitted to frame 21; and a leaf spring 53 normally maintains flange 54 of cylinder 46 contacting the outer surface of flange 51.

The bottom end of tube 40 is fitted to a block 55 made of plastic material and having an axial hole comprising an inner portion 56 with a circular section, and an outer portion 57 with a prismatic, e.g. hexagonal, section. Portion 57 is engaged by a complementary prismatic head 58 integral with a shaft 59; portion 56 houses a spacer washer 60 in removable manner; and shaft 59 rotates on a rolling bearing 61 supported on a second plate 62 fitted to frame 21.

Shaft 59 is also fitted with a toothed driven pulley 63 engaging a drive chain 64 also engaged by a toothed drive pulley 66 fitted to the shaft of geared motor 41, which shaft rotates on a second rolling bearing also supported on plate 62. Geared motor 41 is activated by an electric unit 67 (FIG. 3) described in detail later on.

To load support 18 on to device 15, support 18 must first be wound entirely on to drive roller 38 outside device 15. If roller 38 is already fitted with a support 18 inside device 15, to release roller 38 (FIG. 5) from frame 21, support 18 is first wound entirely on to roller 38, which is then lifted by sliding bush 44 inside seat 47 and raising cylinder 46 against the action of spring 53, so as to release head 58 from prismatic portion 57 of the hole in block 55.

Figure 5:
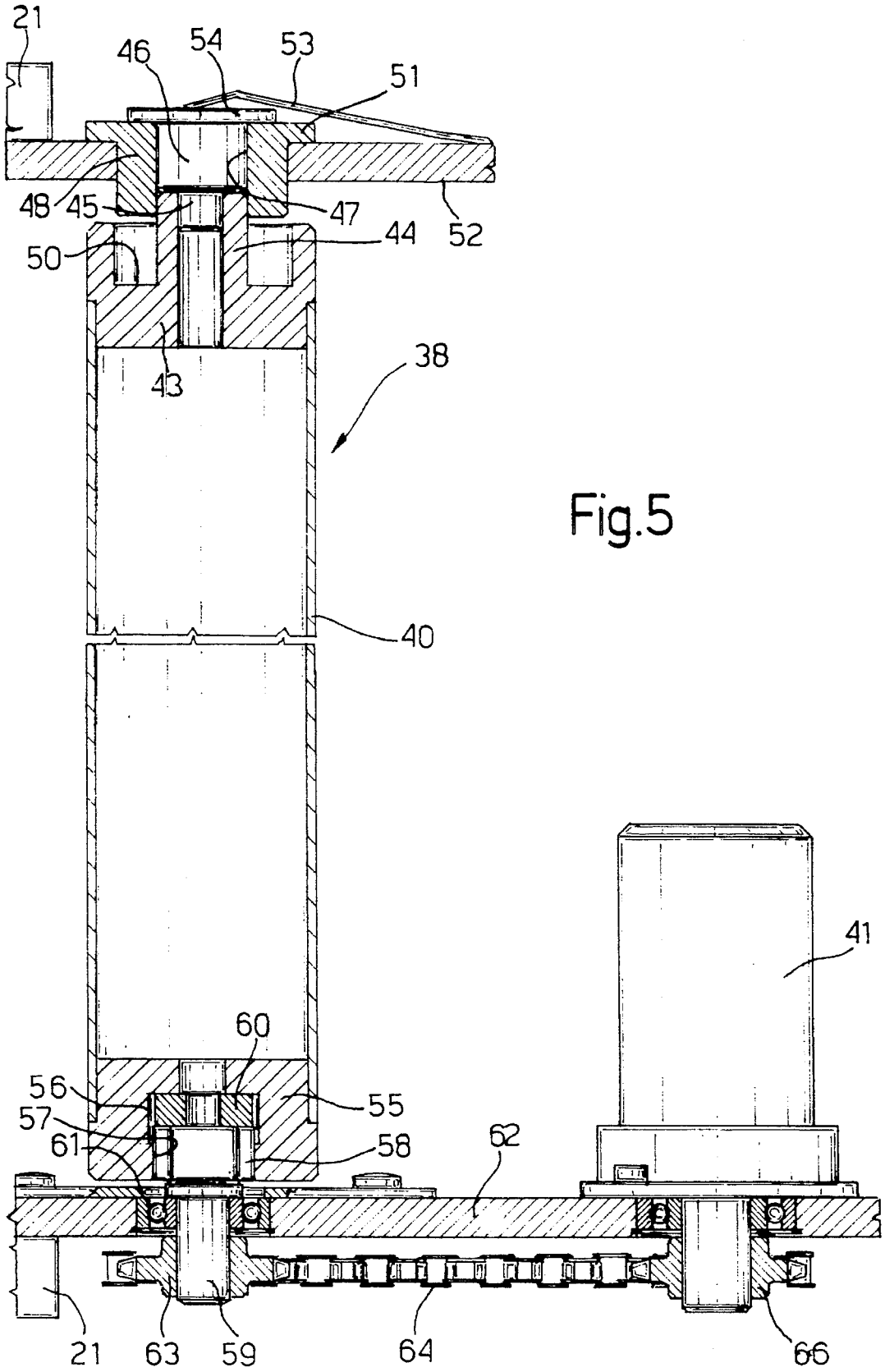
FIG. 5 shows a larger-scale section of a detail in FIG. 3.

At this point, the bottom end of roller 38 is moved sideways; washer 60 is removed from portion 56 of the hole in block 55; and head 58 is re-engaged inside prismatic portion 57, so that roller 38 drops down in relation to the FIG. 5 position, due to the absence of washer 60, pin 45 is withdrawn from bush 44, and the top end of roller 38 is released from sleeve 48. When the top end of the roller is now moved sideways, head 58 may also be released from portion 57.

After changing support 18 on roller 38, this is reassembled between head 58 and sleeve 48 by performing the above operations in reverse order. That is, head 58 is inserted inside portion 57; pin 45 is inserted inside bush 44; roller 38 is lifted to enable insertion of washer 60 inside portion 56; and, on re-engaging head 58, spring 53 restores roller 38 to the axial position shown in FIG. 5. Clearly, therefore, the above procedure provides for troublefree replacement of support 18 on device 15 whenever required.

DRIVEN ROLLER

Driven roller 39 (FIG. 6) also consists of a sheet metal tube 68 fitted at the top end to a disk 69 having an axial pin 70 rotating on a rolling bearing 71 supported on a plate 72 fitted to frame 21. The bottom end of tube 68 is fitted to a metal block 73 having a bush 74 rotating inside a sleeve 75 which presents a flange 76 fitted to a further plate 77 in turn fitted to frame 21. Inwards of tube 68, block 73 presents a portion 78 forming a truncated-cone-shaped hub terminating in a flange 79 with a hole 80 parallel to its axis.

Block 73 presents an axial through hole 81 in which is inserted a metal bush 82 mounted for rotation on one end 83 of a shaft 84. The other end 85 of shaft 84 is fitted in rotary manner inside a dead axial hole 86 in disk 69, and is fitted with a truncated-cone-shaped hub 87 similar to hub 78 and also terminating in a flange 88 with a hole 89 parallel to its axis.

A washer 95 of antifriction material is inserted between flange 88 and disk 69; and, to prevent shaft 84 from withdrawing from block 73, shaft 84 is fitted with a washer 90 adjacent to the end of hub 78. Shaft 84 is covered with a tube 91 of elastic material, e.g. rubber, extending between hub 87 and washer 90.

Torsion spring 42 is a helical type fitted about tube 91 between flanges 79 and 88, and presents two ends 92 and 93 bent axially and inserted inside holes 80 and 89 in flanges 79 and 88, so that spring 42 tends to rotate block 73, integral with roller 39, in relation to hub 87, integral with shaft 84.

End 83 of shaft 84 is fitted with a bush 94 in turn fitted with a radial pin 96 having a prismatic head 97 engaging a shoulder 98 of frame 21, so that shaft 84 is normally locked angularly. Between disk 69 and pin 70, a cylindrical portion 99 presents at least one radial hole 100 in which a pin 101 may be inserted temporarily as shown by the dotted line in FIG. 6.

Spring 42 is loaded by inserting pin 101 inside hole 100 and rotating roller 39 by means of pin 101 so as to compress the coils of spring 42. Once spring 42 is loaded, pin 101 may be engaged in any known manner on a fixed shoulder 102, for keeping spring 42 loaded.

As some of the end coils of spring 42 are wound about hubs 78 and 87, the truncated cone of the hubs is so sized as to prevent chafing and hence wear of the end coils, when compressed, against the lateral surface of the hubs. Moreover, rubber tube 91 prevents metal contact between the other coils of spring 42 and shaft 84, thus providing for noise damping and eliminating wear of spring 42.

Electric unit 67 (FIG. 3) comprises a hand-operated pushbutton 103 for operating geared motor 41 and unwinding support 18 off roller 38 as long as button 103 is depressed. After reassembling roller 38 complete with support 18 on to frame 21, button 103 is pressed so as to unwind part of support 18 off roller 38; end 19 (FIG. 2) is wound by at least two turns on to roller 39; and, on removing pin 101

(FIG. 6) from hole 100, spring 42 provides for tensioning support 18 between rollers 38 and 39.

Subsequently, support 18 is fed in one direction by spring 42 and as controlled by geared motor 41 operated in the corresponding direction. When geared motor 41 is reversed, support 18 is fed in the opposite direction and spring 42 reloaded.

VARIATION OF DRIVEN ROLLER

Figure 13:
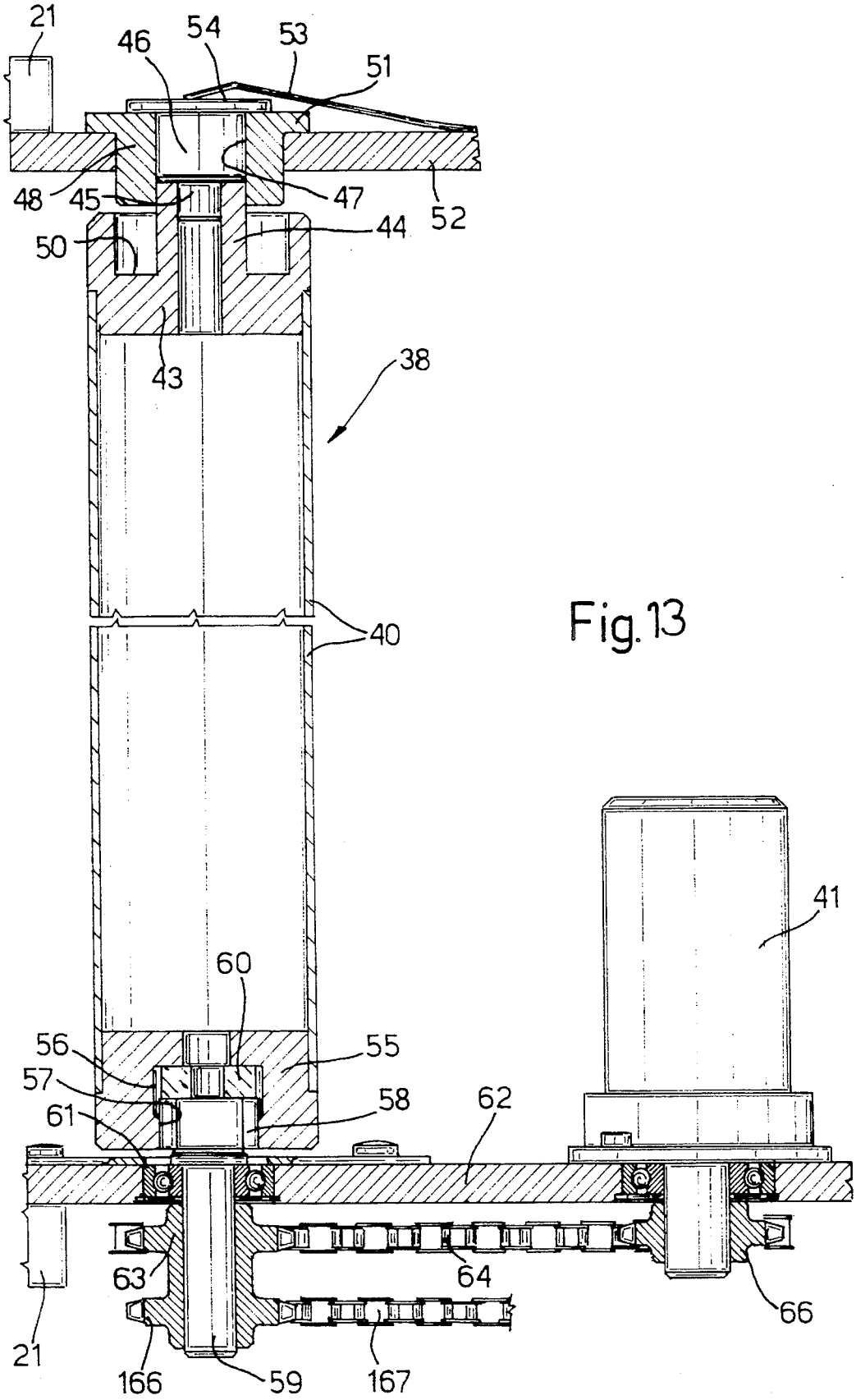
FIG. 13 shows the same section as in FIG. 5, relative to a variation of the present invention.
Figure 14:
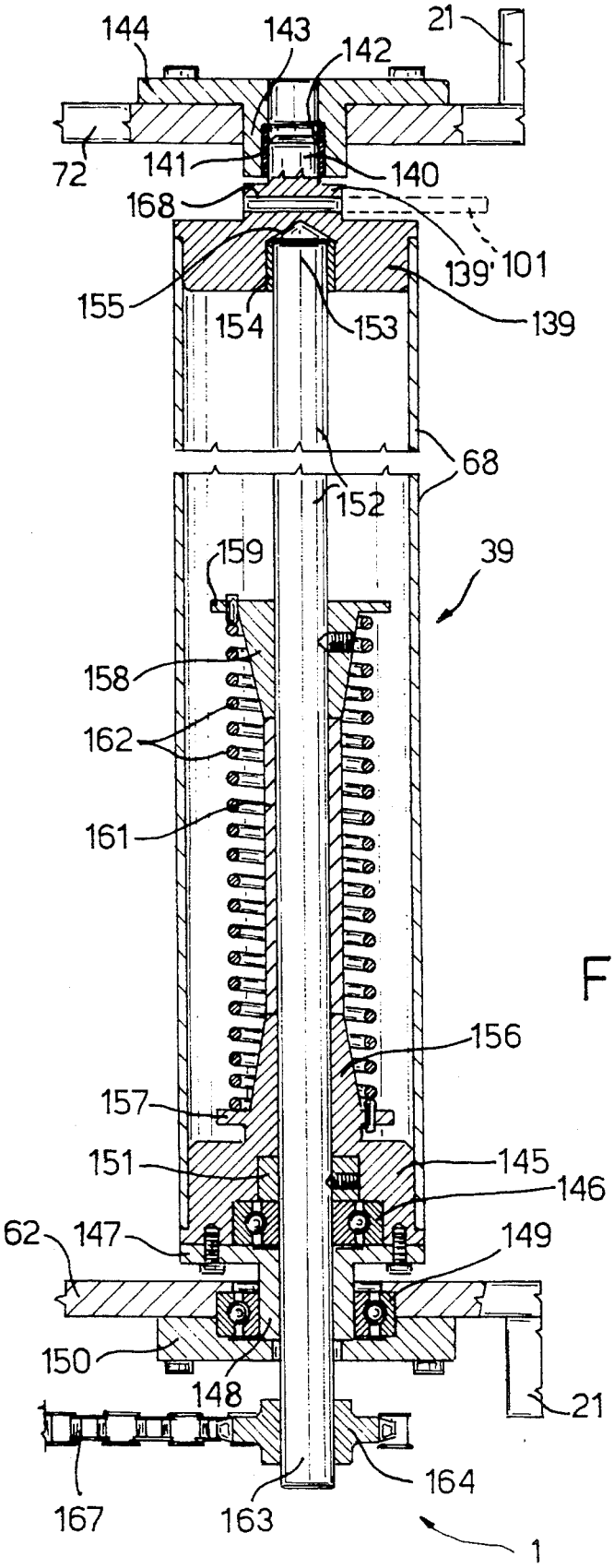
FIG. 14 shows the same section as in FIG. 6, relative to the above variation.

According to the variation shown in FIGS. 13 and 14, the top end of tube 68 of driven roller 39 is fitted to a metal disk 139 in turn fitted by means of a hub 139' with an axial pin 140. Pin 140 rotates inside a bush 141 made of antifriction material and inserted inside the seat 142 of a sleeve 143 having a flange 144 fitted to plate 72 in turn fitted to frame 21.

The bottom end of tube 68 is fitted to a hollow metal block 145 housing a rolling bearing 146 and integral with a disk 147 forming one piece with a bush 148. Bush 148 rotates inside plate 62 of frame 21 by means of a second rolling bearing 149 fitted to plate 62 by means of a disk 150. Bearing 146 presents a hub 151 fitted to a shaft 152 coaxial with tube 68 and the top end 153 of which is mounted for rotation inside a bush 154 housed inside a dead axial hole 155 in disk 139.

Inwards of tube 68, block 145 presents a portion 156 forming a truncated-cone-shaped hub terminating with a flange 157. An intermediate portion of shaft 152 is fitted with a further truncated-cone-shaped hub 158 similar to hub 156 and also terminating with a flange 159. Between hubs 156 and 158, shaft 152 is covered with a tube 161 of elastic material, e.g. rubber.

Figure 6:
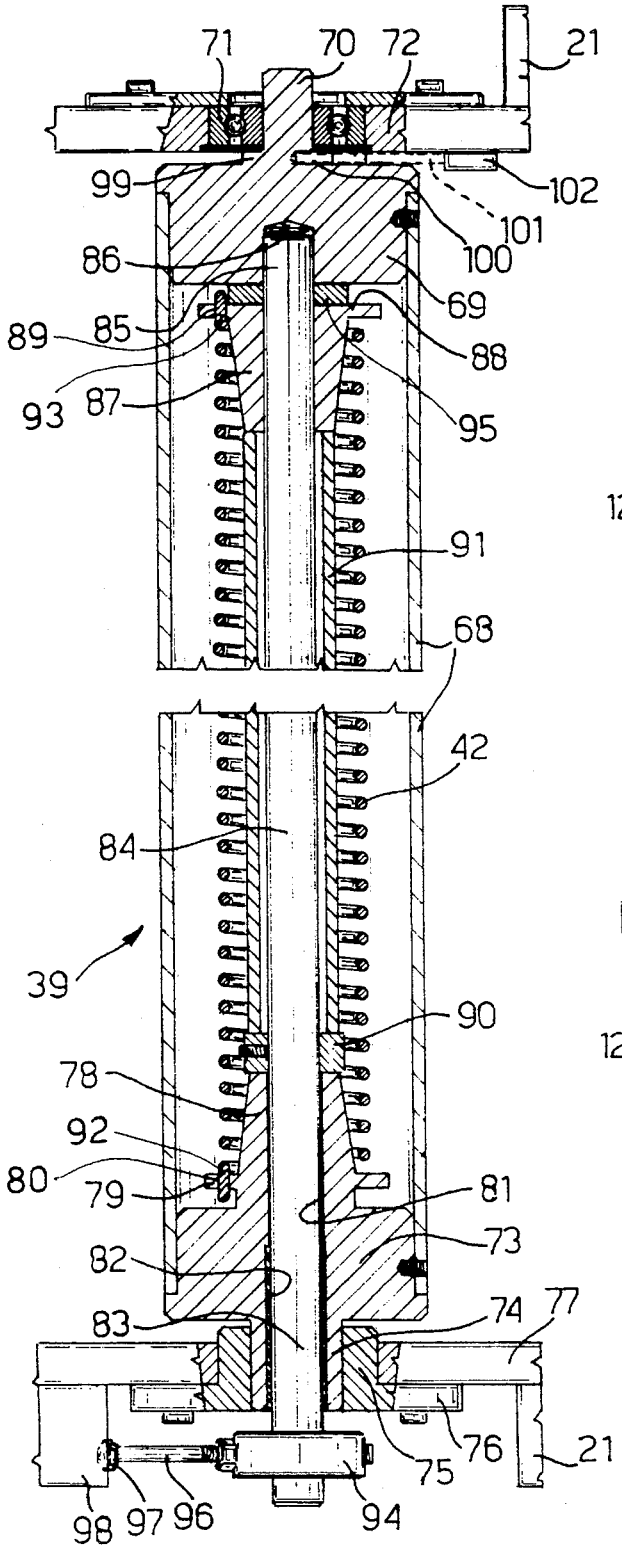
FIG. 6 shows a larger-scale section of a further detail in FIG. 3.

Shaft 152 is connected angularly to tube 68 via elastic means consisting of a helical type torsion spring 162 fitted about tube 161 and the two ends of which are bent axially and inserted inside two holes in flanges 157 and 159 in the same way as spring 42 in FIG. 6.

Shaft 152 (FIG. 14) is rotated synchronously by drive roller 38, which is substantially identical to that of FIG. 5, for which purpose the bottom end 163 of shaft 152 is fitted with a toothed pulley 164, while shaft 59 (FIG. 13) is fitted with a further pulley 166 identical to pulley 164 and which may advantageously form one piece with pulley 63. Both pulleys 164 and 166 are engaged by a second drive chain 167.

Spring 162 is so sized as to enable tube 68 to be rotated in relation to shaft 152 by a sufficient number of turns—advantageously ranging from 10 to 20—as to wind the end of support 18 on to roller 39, and absorb any difference in rotation of rollers 38 and 39 due to a variation in the number of turns of support 18 on rollers 38 and 39. Spring 162 may be loaded either by means of a pin 101 inserted inside in a radial hole 168 in hub 139' of disk 139, or by manually rotating tube 68 in relation to shaft 152.

As some of the end coils of spring 162 are wound about hubs 156 and 158, the truncated cone of the hub is so sized as to prevent chafing of the end coils, when compressed, against the lateral surface of the hub. Moreover, rubber tube 161 prevents metal contact between the other coils of spring 162 and shaft 152.

After fitting roller 38 complete with support 18 on to frame 21 (FIG. 1) and loading spring 162, the free end of support 18 is fitted on to roller 39; and spring 162 (FIG. 3) is allowed to rotate roller 39 so as to wind support 18 by at least one turn, at which point, support 18 is maintained at substantially constant tension by spring 162.

When rotated in one direction, geared motor 41 provides for feeding support 18 from roller 38 to roller 39, in which case geared motor 41, via chain 64, rotates roller 38 which, via chain 167, rotates shaft 152 by the same number of turns; and spring 162 elastically rotates tube 68 so as to tension support 18 which is thus wound on to roller 39.

When geared motor 41 is reversed, support 18 is fed in reverse from roller 39 to roller 38, in which case chain 167 rotates shaft 152 in the opposite direction, which rotation is followed elastically by tube 68 by virtue of spring 162. In both cases, therefore, spring 162 provides for taking up any slack due to the difference in the thickness of support 18 on rollers 38 and 39.

ELECTRIC UNIT

Frame 21 (FIGS. 1 and 3) is fitted with a number of pairs of supports 106, each pair fitted with a lamp 107, e.g. a neon tube. Supports 106 are fitted to the rear of the two horizontal members 22, so that lamps 107 are parallel to rollers 38 and 39. Lamps 107 are mains supplied by means of a switch 108 (FIG. 11) for turning on device 15 and supplying electric unit 67.

Electric unit 67 substantially comprises a regulated power supply unit 109 connected to an electronic unit 111 controlling geared motor 41. More specifically unit 111 provides for receiving and processing signals generated by a sensor 112, for driving a control circuit or driver 113 of geared motor 41.

Sensor 112 (FIGS. 3 and 4) may be an optical, magnetic proximity or any other type of sensor, and is preferably a capacitive type designed to read metal markers, and located centrally in relation to display window 20. With the exception of the two end advertisements 16, each advertisement 16 of support 18 (FIG. 2) presents at the bottom a metal strip or marker 114 of a given length substantially equal to the width or diameter of sensor 112, and located in a position corresponding to sensor 112, i.e. centrally in relation to the width of advertisement 16.

On detecting the passage of marker 114, sensor 112 generates a signal of a given duration, which is supplied to unit 111. On recognizing the signal, unit 111 controls driver 113 (FIG. 11) so as to temporarily stop geared motor 41 and so arrest advertisement 16 perfectly centered in relation to display window 20. The display time of the advertisement is adjustable by means of a knob 116 for regulating in known manner a delay circuit in unit 111.

The two end advertisements 16 of support 18 (FIG. 2) present respective metal strips or markers 117 and 118, each much longer than, and extending outwards from the corresponding position of, marker 114. Upon marker 117 or 118 reaching sensor 112, this again provides for temporarily stopping geared motor 41; and, when support 18 again starts moving, the passage of marker 117 or 118 past sensor 112 causes this to generate a much longer signal which is recognized by unit 111 which so controls driver 113 as to reverse geared motor 41.

It should be noted that support 18 is kept a given distance from wall 29 (FIG. 4) by a pair of tabs 115 fitted to a fixed bracket 119, so as to ensure optimum viewing of advertisements 16 as well as accurate reading of markers 114, 117 and 118 by sensor 112.

Moreover, tabs 115 provide for limiting static due to friction between support 18 and wall 29 and which may possibly affect the signals supplied by sensor 112; and electric unit 67 is enclosed in a metal shield 120 acting as a Faraday cage for further protecting sensor 112.

Centrally, tube 68 of roller 39 presents two parallel slots 121 and 122 (FIGS. 7 and 8) extending over a given angle; and the portion 123 of tube 68 between slots 121 and 122 is drawn inwards. Inside slots 121 and 122 are inserted two tabs 124 of a sheet 125 of flexible plastic material designed to wind about tube 68 and which engages a pushbutton 126 for activating in known manner a switch 127 (FIG. 11) located between driver 113 and geared motor 41 and which, when activated, provides for stopping geared motor 41.

When support 18 (FIG. 4) is wound by at least one turn on roller 39, sheet 125 is wound about tube 68 and has no effect on pushbutton 126. Conversely, in the event support 18 unwinds accidentally off tube 68, this frees sheet 125 which, being elastic, unwinds and, as tube 68 rotates, activates pushbutton 126 so as to stop geared motor 41. To re-start geared motor 41, support 18 must be rewound partly on to roller 39.

Figure 12:
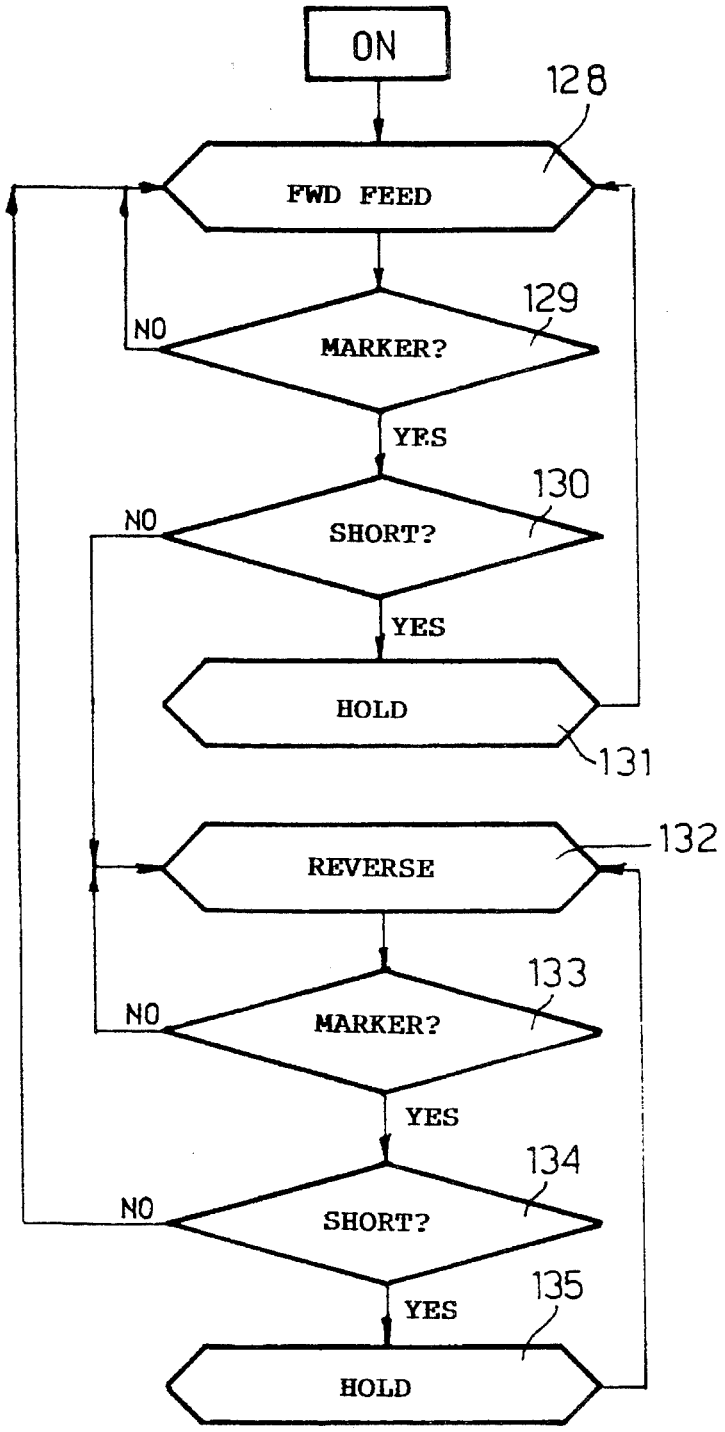
FIG. 12 shows an operating flow chart of the device.

Operation of device 15 will now be described with reference to the flow chart in FIG. 12.

After fitting roller 38 complete with support 18 on to frame 21 (FIG. 1) and fitting support 18 on to roller 39, wall 33 is closed and switch 108 operated to light lamps 107. At this point, logic unit 111 controls driver 113 so as to rotate geared motor 41 in such a direction as to feed support 18 from roller 38 to roller 39 (block 128 in FIG. 12).

Figure 11:
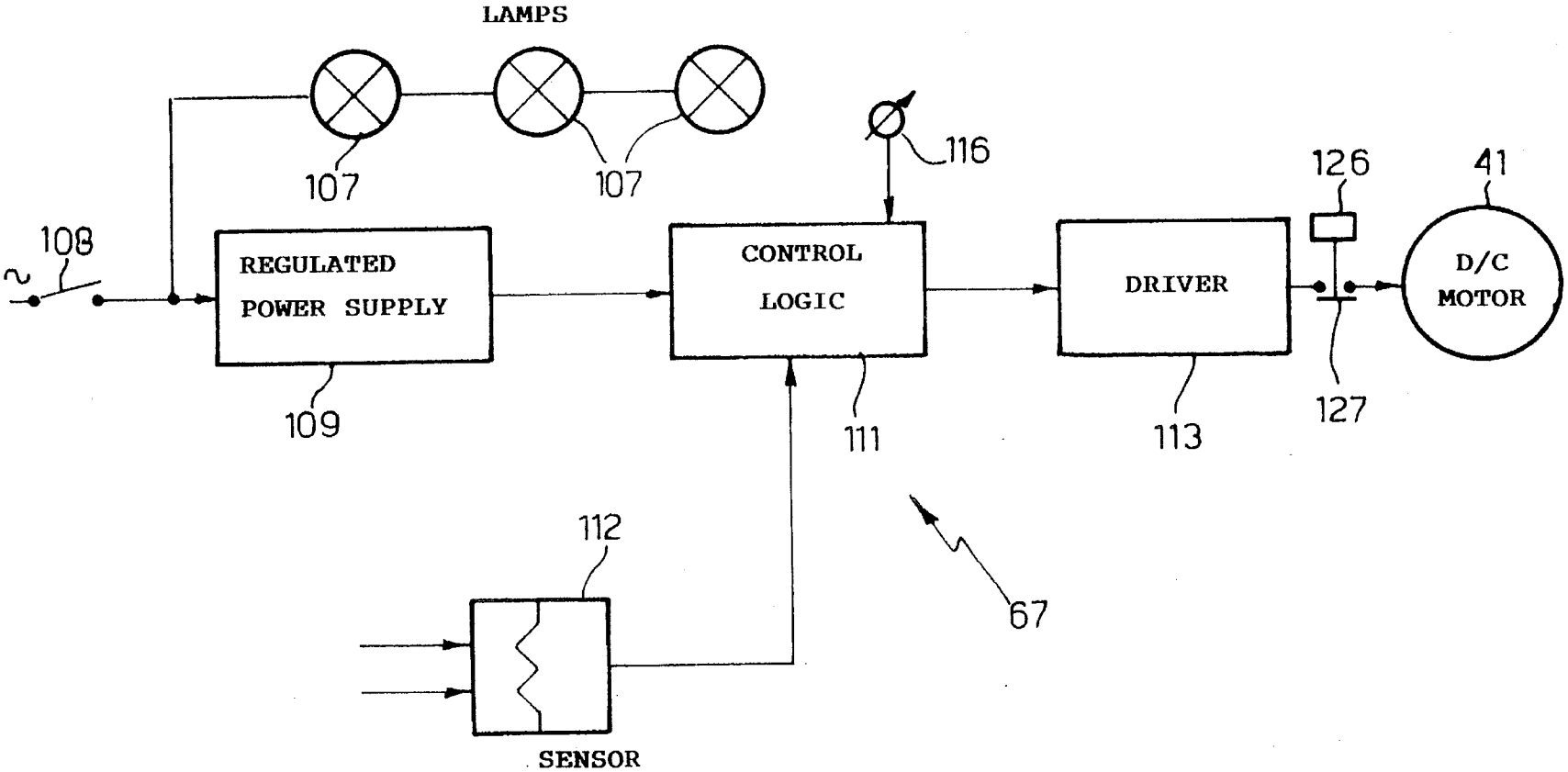
FIG. 11 shows a block diagram of the electric control unit on the device.

In block 129, unit 111 provides periodically for determining whether a marker 114, 117 or 118 has been detected by sensor 112. In the event of a negative response, block 129 goes back to block 128. Conversely, in the event of a positive response, block 129 goes on to block 130 which determines whether the detected marker is a short marker 114. In the event of a positive response, block 130 goes on to block 131 which provides for a hold operation wherein geared motor 41 is stopped and the corresponding advertisement 16 centered in display window 20 (FIG. 1) for the length of time set by knob 116 (FIG. 11).

In the event of a negative response in block 130, i.e. display of one of the end advertisements 16 and detection by sensor 112 of long marker 118, block 130 goes on to block 132 wherein unit 111 so controls driver 113 as to reverse geared motor 41 and hence support 18. By means of two blocks 133 and 134 similar to blocks 129 and 130, unit 111 either goes on to block 135 wherein geared motor 41 is temporarily stopped, or returns to block 128 wherein geared motor 41 is so operated as to again feed support to roller 39.

The advantages of the display device according to the present invention will be clear from the foregoing description. In particular, support 18 is capable of accommodating a large number of advertisements 16, thus increasing the time interval between repeat display of a given advertisement, as well as increasing both display capacity and the interest of the viewer.

Moreover, the removability of drive roller 38 provides for troublefree changeover of support 18 which may be loaded easily on to drive roller 38 on a straightforward work table. Finally, spring operation of driven roller 39 ensures substantially constant tension at all times of support 18 at display window 20.

FURTHER VARIATIONS AND EMBODIMENTS

Frame 21 may be of any size for displaying advertisements of any format, in particular standard international, e.g. ISO, formats. The mechanism for various formats may consist of the same components, the only alterations required being to the length of tubes 40 and 68 of rollers 38 and 39, and the length and number of lamps 107. Box 24 may be positioned so that rollers 38 and 39 and lamps 107 are horizontal, in which case, advertisements 16 will be joined by the top and bottom edges and will be fed vertically.

Figure 9:
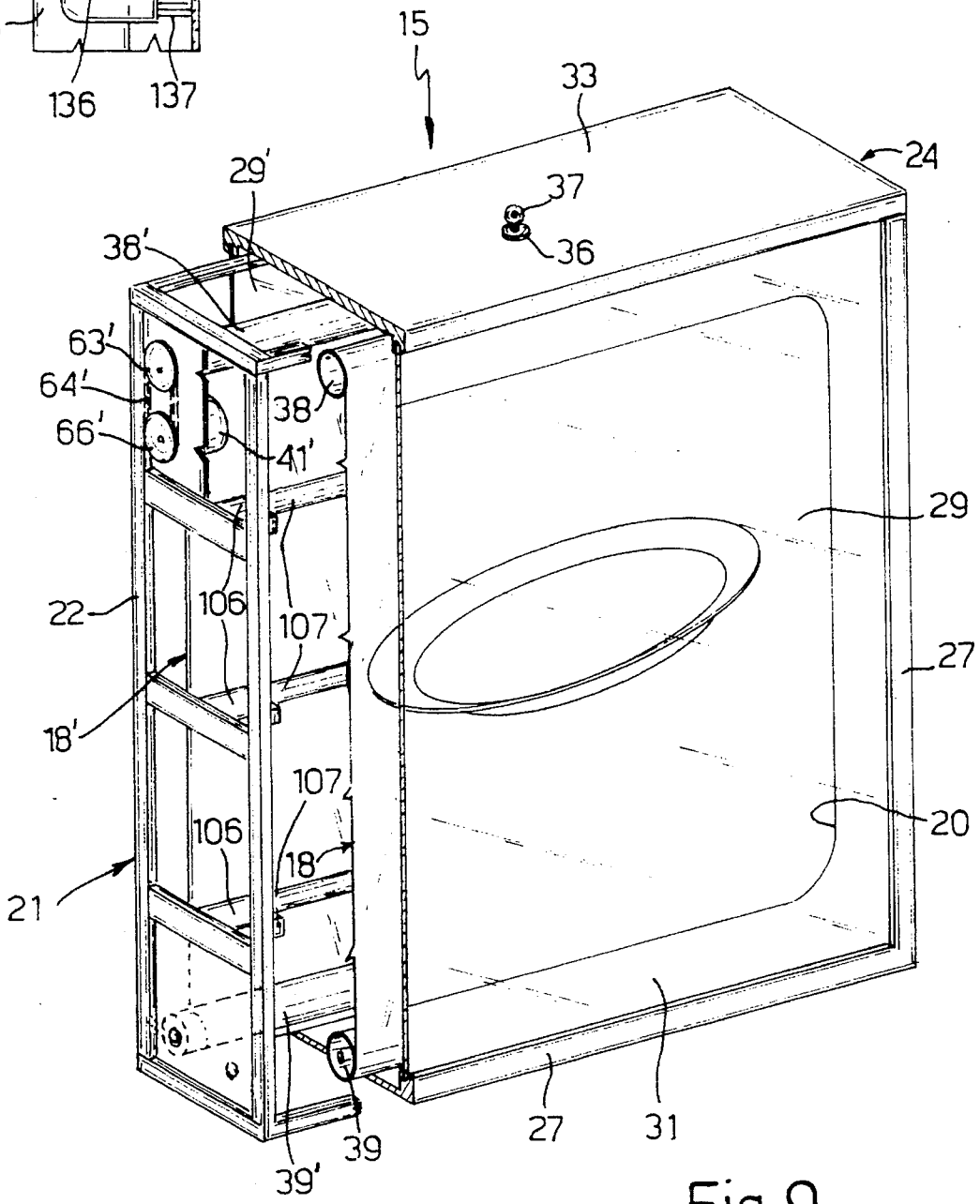
FIG. 9 shows a view in perspective of a further embodiment of the device according to the present invention.

In the FIG. 9 embodiment, in which advertisements 16 are fed vertically, box 24 presents two transparent walls 29 and 29' with one set of lamps 107 in between; removable wall 33 is positioned horizontally; and frame 21 is fitted with two pairs of rollers 38–39, 38'–39' symmetrical with each other, and each of which provides for feeding a respective support 18, 18' which is displayed through respective wall 29, 29'.

The two drive rollers 38, 38' may be driven either by two separate geared motors 41 (only one shown in FIG. 9), or synchronously by a single geared motor 41 connected to rollers 38, 38' by appropriate drive means.

Figure 10:
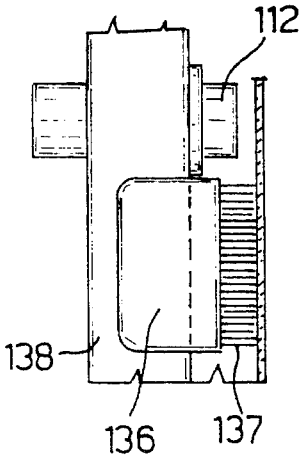
FIG. 10 shows a schematic detail of a variation of the device according to the present invention.

According to the FIG. 10 variation, the static of support 18 may be discharged by means of a brush 136 of conducting material with a number of tungsten wires 137, the brush 136 being grounded on a portion 138 of frame 21 close to sensor 112. As it moves, support 18 brushes continually against wires 137 of brush 136 which thus provides for discharging the static of support 18.

To those skilled in the art it will be clear that further changes and improvements may be made to the embodiments described without, however, departing from the scope of the present invention. For example, helical spring 42 may be replaced by a spiral spring; rollers 38 and 39 may be operated by two separate motors via friction means for ensuring constant tension of support 18; and, for assembling drive roller 38, axial travel may be provided for enabling elimination of washer 60.

Figure 7:
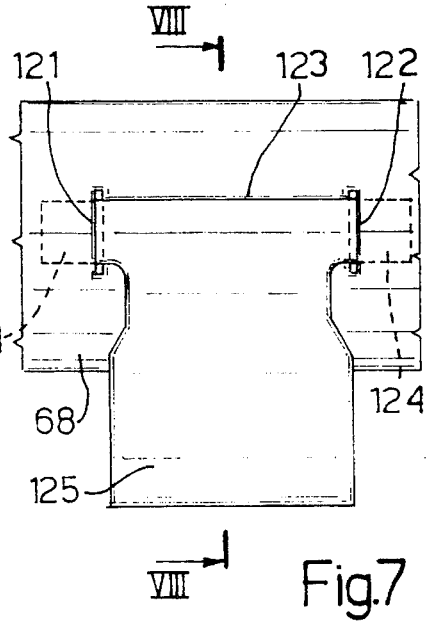
FIG. 7 shows part of the FIG. 6 detail.
Figure 8:
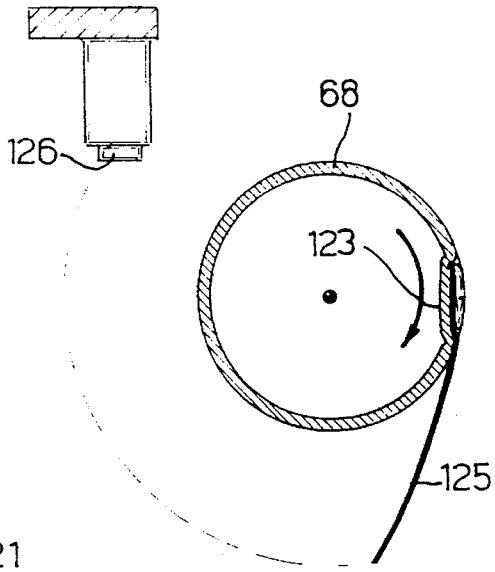
FIG. 8 shows a section along line VIII—VIII in FIG. 7.

Also, drive roller 38 may also be provided with a safety device 125–126 similar to that of driven roller 39 in FIGS. 7 and 8; box 24 may be opened by rotating transparent wall 29 which, in this case, will be hinged and fitted with a lock; and provision may be made for lamps other than the neon tube types described, and/or for means for turning the lamps off during displacement of support 18.

I claim:

1. A device for displaying in a display window a series of advertisements, said device comprising a flexible strip support (18) including a plurality of advertisements (16), wherein said support (18) is wound and unwound between two parallel rollers (38, 39), and is fitted on one side to a first of said rollers (38, 39) and on the other side to a second of said rollers (38, 39); a reversible motor (41) for intermittently rotating at least said first roller (38) for successively displaying said advertisements (16) one at a time; elastic means (42, 162) acting on said second roller (39) for permanently maintaining said support (18) at a predetermined tension, said first roller (38) being angularly integral with a first pulley (63); and a flexible drive member (64) provided between said first pulley and a second pulley (66) rotated by said motor (41); and wherein said first roller (38) is fitted removably to a fixed frame (21) for enabling replacement of said support (18), said first roller (38) comprising, at one end, a bush (44) engaged by an elastic pin (45) movable elastically in an axial direction for enabling removal of said first roller (38) from said frame (21).

2. A device as claimed in claim 1, characterized by the fact that said first pulley (63) is fitted to a rotary member (59) on said frame (21); connecting means (57, 58) being provided between said member (59) and the other end of said first roller (38).

3. A device as claimed in claim 2, characterized by the fact that said connecting means (57, 58) comprise a polygonal-section driving element (58) engaging a hollow counter-element (57) on said first roller (38) having a section complementary to that of said rotating element (58); means (60) being provided for axially locking said first roller (38) between said driving element (58) and said elastic pin (45).

4. A device as claimed in claim 1, characterized by the fact that said elastic means comprise a helical torsion spring (42, 162) having one end (92) fitted to a first flange (79, 157) in turn fitted to said second roller (39); said first flange (79, 157) being mounted for rotation on said frame (21).

5. A device as claimed in claim 4, characterized by the fact that said torsion spring (42, 162) presents another end (93) fitted to a second flange (88, 159) in turn fitted to a shaft (84, 152) coaxial with said second roller (39).

6. A device as claimed in claim 5, characterized by the fact that each said flange (79, 157; 88, 159) presents a hub (78, 156; 87, 158) about which is wound a number of coils of said torsion spring (42, 162); said hub being truncated-cone-shaped with a narrower end facing a central portion of said torsion spring (42, 162).

7. A device as claimed in claim 6, characterized by the fact that said shaft (84, 152) is covered with a tube (91, 161) of flexible or noise-damping material located between said hubs (78, 156; 87, 158); the coils of said torsion spring (42, 162) being wound about said tube (91, 161).

8. A device as claimed in claim 5, characterized by the fact that said first flange (79) is angularly integral with a first end (83) of said shaft (84); said second flange (88) being fitted to the other end (85) of said shaft (84); said first end (83) of said shaft (84) being maintained angularly fixed in relation to said frame (21).

9. A device as claimed in claim 5, characterized by the fact that said first flange (157) is fitted to a first end (163) of said shaft (152); said second flange (159) being fitted to an intermediate portion of said shaft (152); said first end (163) of said shaft (152) being integral with a pulley (164) connected by a second flexible member (167) to a further pulley (166) integral with said first roller (38).

10. A device as claimed in claim 1, characterized by the fact that said frame (21) is housed inside a closed box (24) having at least one removable wall (33) for enabling removal of said first roller (38); said removable wall (33) being locked by means of lock means (36) operated by a key (37); said box (24) comprising a front wall (29) made of relatively flexible material and having a transparent portion defining said display window (20); and said box (24) presenting, on three sides, a groove (28) for receiving three sides of said front wall (29); another side of said front wall (29) being engaged in a groove (34) in said removable wall (33).

11. A device as claimed in claim 1, characterized by the fact that said motor (41) is controlled by a logic unit (111), and at least one of said rollers (38, 39) presents a signaling element (125) maintained in an idle position by at least one turn of said support (18) wound about said roller (38, 39); said signaling element (125) being designed to operate a switch for causing said logic unit (111) to arrest said motor (41), when released by said support (18).

12. A device as claimed in claim 11, wherein said signaling element is formed of a sheet (125) of flexible plastic material having on one end a pair of tabs (124) inserted inside corresponding slots (121, 122) of said roller (38, 39), and being provided with a portion adapted to operate said switch.

13. A device for displaying in a display window a series of advertisements, said device comprising a flexible strip support (18) including a plurality of advertisements (16), wherein said support (18) is wound and unwound between two parallel rollers (38, 39), and is fitted on one side to a first of said rollers (38, 39) and on the other side to a second of said rollers (38, 39), each said roller (38, 39) having a predetermined diameter; a reversible motor (41) for intermittently rotating at least said first roller (38) for successively displaying said advertisements (16) one at a time; and elastic means (42, 162) acting on said second roller (39) for permanently maintaining said support (18) at a predetermined tension; and wherein two lateral portions of each said roller (38, 39) present two bands (35) for increasing a diameter of the roller by 0.2 to 2 mm and correctly tensioning said support (18) over its full width.

14. A device for displaying in a display window a series of advertisements, said device comprising a flexible strip support (18) including a plurality of advertisements (16), wherein said support (18) is wound and unwound between two parallel rollers (38, 39), and is fitted on one side to a first of said rollers (38, 39) and on the other side to a second of said rollers (38, 39); a reversible motor (41) for intermittently rotating at least said first roller (38) for successively displaying said advertisements (16) one at a time; elastic means (42, 162) acting on said second roller (39) for permanently maintaining said support (18) at a predetermined tension; a front wall (29) carrying said front window (20), a frame (21) carrying said rollers (38, 39); and means for keeping said support (18) a given distance from said front wall (29); at least one brush (136) being fitted to a portion (138) of said frame (21) and having a number of wires (137) made of electrically conductive material and against which said support (18) brushes to discharge the static electricity accumulated in said support (18).

15. A device as claimed in claim 14, characterized by the fact that said motor (41) is controlled by a logic unit (111) in turn controlled by a sensor (112) for detecting reference elements which is so located as to enable said sensor (112) to determine central positioning of said advertisement in said display window (20); each end advertisement (16) of said support (18) presenting a reference element (117, 118) enabling said sensor (112) to provide for reversing said motor (41), said keeping means comprising a pair of tabs (115) located adjacent to said sensor (112) for enabling a correct sensing of said reference elements (114, 117, 118), said logic unit (111) and said sensor (112) being protected by a Faraday cage (120) fitted to said frame (21).

16. A device for displaying in a display window a series of advertisements, said device comprising a flexible strip support (18) including a plurality of advertisements (16), wherein said support (18) is wound and unwound between two parallel rollers (38, 39), and is fitted on one side to a first of said rollers (38, 39) and on the other side to a second of said rollers (38, 39); a frame (21) for mounting said rollers (38, 39) to a reversible motor (41) for intermittently rotating at least said first roller (38) for successively displaying said advertisements (16) one at a time; and a helical torsion spring (42, 162) mounted inside said second roller (39) for permanently maintaining said support (18) at a predetermined tension, said torsion spring (42, 162) having one end (92) fitted to a first flange (79, 157) in turn fitted to said second roller (39), said first flange (79, 157) being mounted for rotation on said frame (21), said torsion spring (42, 162) having another end fitted to a second flange (88, 159) in turn fitted to a shaft (84, 152) coaxial with said second roller (39), each said flange (79, 157; 88, 159) including a hub (78, 156; 87, 158) about which is wound a number of coils of said torsion spring (42, 162); said hub being truncated-cone-shaped with a narrower end facing a central portion of said torsion spring (42, 162).

* * * * *